US010234807B2

(12) United States Patent
Hatanaka et al.

(10) Patent No.: US 10,234,807 B2
(45) Date of Patent: Mar. 19, 2019

(54) IMAGE FORMING APPARATUS

(71) Applicant: CANON KABUSHIKI KAISHA, Tokyo (JP)

(72) Inventors: Yuichi Hatanaka, Kashiwa (JP); Masahiro Makino, Tsukubamirai (JP); Ryuta Ai, Tokyo (JP); Takashi Ueno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/623,867

(22) Filed: Jun. 15, 2017

(65) Prior Publication Data

US 2017/0371287 A1 Dec. 28, 2017

(30) Foreign Application Priority Data

Jun. 24, 2016 (JP) ..... 2016-126038

(51) Int. Cl.
*G03G 15/00* (2006.01)

(52) U.S. Cl.
CPC ..... *G03G 15/55* (2013.01)

(58) Field of Classification Search
CPC ..... G03G 15/55
See application file for complete search history.

(56) References Cited

U.S. PATENT DOCUMENTS

| | | | | |
|---|---|---|---|---|
| 5,678,125 | A | 10/1997 | Kutsuwada et al. | |
| 5,815,767 | A | 9/1998 | Kutsuwada et al. | |
| 6,850,714 | B2 | 2/2005 | Sakurai et al. | |
| 6,963,703 | B2 | 11/2005 | Hisakuni | |
| 7,024,127 | B2 | 4/2006 | Hisakuni | |
| 2009/0016769 | A1* | 1/2009 | Hatakeyama | G03G 21/00 399/107 |
| 2013/0195475 | A1* | 8/2013 | Kubo | G03G 15/0283 399/26 |

FOREIGN PATENT DOCUMENTS

| | | | |
|---|---|---|---|
| JP | 8-314221 | A | 11/1996 |
| JP | 2002-072573 | A | 3/2002 |
| JP | 2004-004544 | A | 1/2004 |
| JP | 2007-304523 | A | 11/2007 |

OTHER PUBLICATIONS

U.S. Appl. No. 15/416,483, Takashi Ueno Masashiro Makino Ryuta Ai Yuichi Hatanaka, filed Jan. 26, 2017.

* cited by examiner

*Primary Examiner* — Ryan D Walsh
(74) *Attorney, Agent, or Firm* — Venable LLP

(57) ABSTRACT

An image forming apparatus includes an image bearing member, a toner image forming portion, a transfer member, a cleaning member, and a controller configured to carry out a process for notifying information on a lifetime of the image bearing member on the basis of information on contact pressure of the cleaning member to the image bearing member.

20 Claims, 5 Drawing Sheets

IMAGE FORMING APPARATUS

FIELD OF THE INVENTION AND RELATED ART

The present invention relates to an image forming apparatus, such as a copying machine, a printer, a facsimile machine or a multifunction machine having functions of these machines, of an electrophotographic type.

In the image forming apparatus of the electrophotographic type, a photosensitive member which is an image bearing member is electrically charged and exposed to light and thus an electrostatic latent image is formed on the photosensitive member and then a toner image is formed on the photosensitive member by depositing toner on the electrostatic latent image. Then, the toner image formed on the photosensitive member is transferred onto a recording material such as paper directly or via an intermediary transfer member, but toner (residual toner) which has not been transferred remains on the photosensitive member. Accordingly, the residual toner on the photosensitive member is removed from the surface of the photosensitive member by a cleaning means. As the cleaning means, a cleaning device provided with a cleaning blade as a cleaning member provided in contact with the photosensitive member has been widely used.

The surface of the photosensitive member is rubbed with the cleaning blade with image formation, and therefore a film thickness of a photosensitive layer decreases. When the film thickness of the photosensitive layer decreases in a certain amount or more, a proper image cannot be formed in some cases.

Japanese Laid-Open Patent Application 2007-304523 discloses a technique such that even when a film thickness of a photosensitive layer changes, a proper image is intended to be formed by controlling an exposure amount in accordance with a correction formula depending on the number of rotations of a photosensitive member and the number of pixels of the image.

However, in the technique disclosed in JP-A 2007-304523, in some cases, it becomes difficult to exchange a unit including the photosensitive member at proper timing when the photosensitive member reaches an end of a lifetime thereof.

SUMMARY OF THE INVENTION

According to an aspect of the present invention, there is provided an image forming apparatus comprising: an image bearing member configured to bear a toner image; a toner image forming portion configured to form the toner image on the image bearing member; a transfer member configured to transfer the toner image from the image bearing member onto a toner image receiving member; a cleaning member provided in contact with the image bearing member and configured to remove toner remaining on a surface of the image bearing member after transfer; and a controller configured to carry out a process for notifying information on a lifetime of the image bearing member on the basis of information on contact pressure of the cleaning member to the image bearing member.

According to another aspect of the present invention, there is provided an image forming apparatus comprising: a photosensitive member including a base material and a photosensitive layer provided on the base material; a toner image forming portion configured to form the toner image on the photosensitive member; a transfer member configured to transfer the toner image from the photosensitive member onto a toner image receiving member; and a controller configured to carry out a process for notifying information on a lifetime of the photosensitive member on the basis of initial film thickness information on an initial film thickness which is a film thickness of the photosensitive member at an initial stage of use of the photosensitive member.

According to a further aspect of the present invention, there is provided an image forming apparatus comprising: a photosensitive member including a base material and a photosensitive layer provided on the base material; a toner image forming portion configured to form the toner image on the photosensitive member; a transfer member configured to transfer the toner image from the photosensitive member onto a toner image receiving member; a cleaning member provided in contact with the photosensitive member and configured to remove toner remaining on a surface of the photosensitive member after transfer; and a controller configured to carry out a process for notifying information on a lifetime of the photosensitive member on the basis of contact pressure information on contact pressure of the cleaning member to the photosensitive member and initial film thickness information on an initial film thickness which is a film thickness of the photosensitive member at an initial stage of use of the photosensitive member.

Further features of the present invention will become apparent from the following description of exemplary embodiments with reference to the attached drawings.

DESCRIPTION OF EMBODIMENTS

An image forming apparatus according to the present invention will be described with reference to the drawings.

Embodiment 1

1. General Constitution and Operation of Image Forming Apparatus

Figure 1:
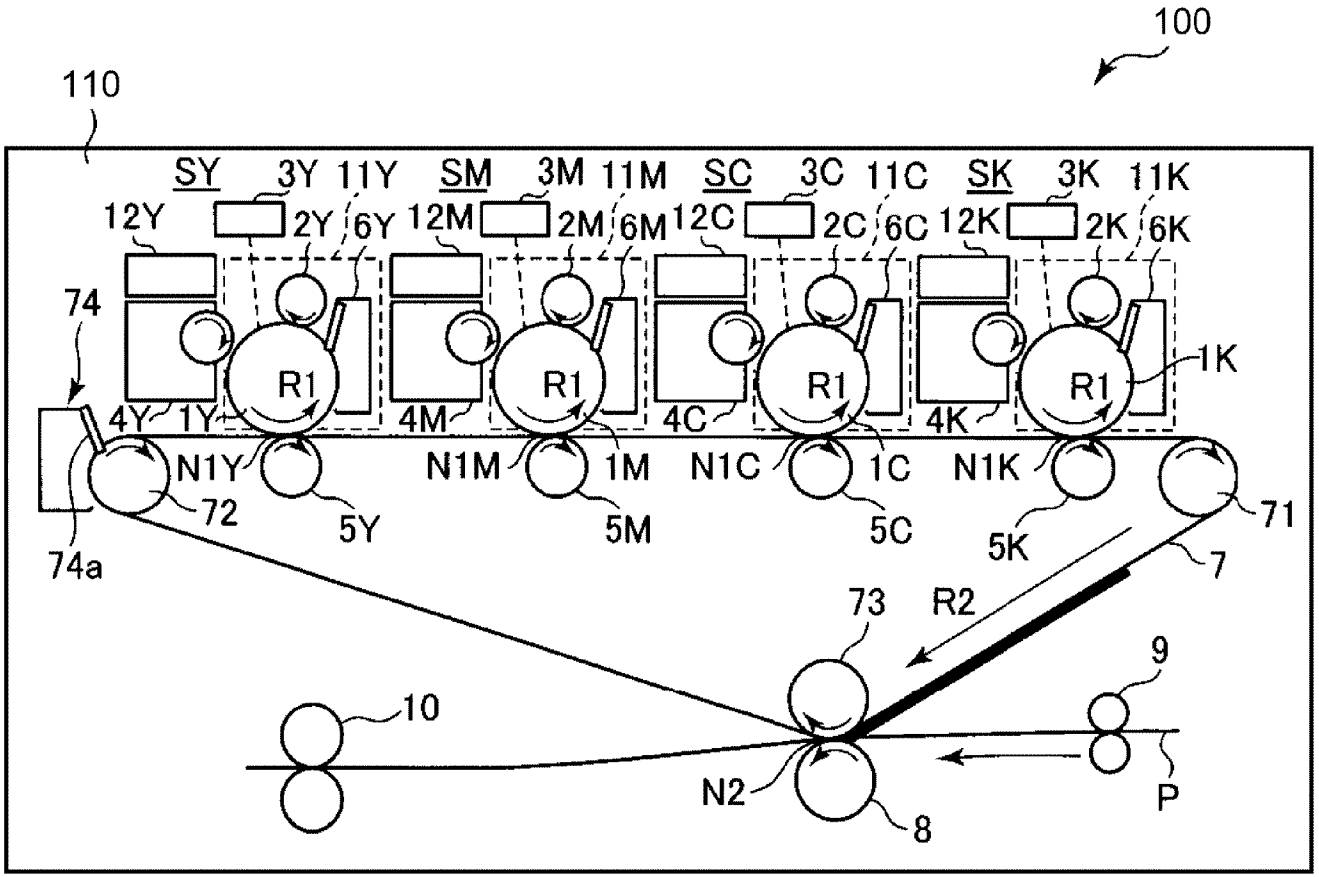
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type printer, employing an electrophotographic type, and an intermediary transfer type, capable of forming a full-color image.

The image forming apparatus 100 includes, as a plurality of image forming portions (stations), first to fourth image forming portions SY, SM, SC and SK for forming images of yellow (Y), magenta (M), cyan (C) and black (K), respectively. As regards elements having the same or corresponding function and constitutions in the respective image forming portions SY, SM, SC and SK, suffixes Y, M, C and K representing the elements for associated colors are omitted, and the elements will be collectively described in some instances. In this embodiment, the image forming portion S is constituted by a photosensitive drum 1, a charging roller 2, an exposure device 3, a developing device 4, a primary transfer roller 5, a cleaning device 6, and the like, which are described later.

The photosensitive drum 1 which is a drum-shaped (cylindrical) rotatable photosensitive member (electrophotographic photosensitive member) as a first image bearing member for bearing a toner image is rotationally driven in an indicated arrow R1 direction (counterclockwise direction) in FIG. 1 at a predetermined peripheral speed (process speed). A surface of the rotating photosensitive drum 1 is electrically charged uniformly to a predetermined polarity (negative in this embodiment) and a predetermined potential by the charging roller 2 which is a roller-type charging member as a charging means. During a charging step, to the charging roller 2, a charging voltage (charging bias) which is an oscillating voltage in the form of a negative DC voltage biased with an AC voltage is applied.

The surface of the charged photosensitive drum 1 is exposed to light depending on image information by the exposure device (laser scanner) 3 as an exposure means, so that an electrostatic latent image (electrostatic image) is formed on the photosensitive drum 1.

The electrostatic image formed on the photosensitive drum 1 is developed (visualized) by supplying the toner as a developer by the developing device 4, so that the toner image is formed on the photosensitive drum 1. In this embodiment, the toner negatively charged to the same polarity (negative in this embodiment) as the charge polarity of the photosensitive drum 1 is deposited on an exposed portion of the photosensitive drum 1 which is lowered in absolute value of the potential by the exposure to light after the photosensitive drum 1 is charged uniformly.

An intermediary transfer belt 7, as a second image bearing member for carrying the toner image, which is an intermediary transfer member constituted by an endless belt as an intermediary transfer member, is provided opposed to the respective photosensitive drums 1 of the image forming portions S. The intermediary transfer belt 7 is extended around a driving roller 71, a tension roller 73 and a secondary transfer opposite roller 72, which are used as a plurality of supporting rollers (stretching rollers), and is stretched with a predetermined tension. In an inner peripheral surface side of the intermediary transfer belt 7, the primary transfer roller 5, which is a roller type primary transfer member as a primary transfer means, is provided corresponding to the photosensitive drum 1. The primary transfer roller 5 is pressed (urged) against the intermediary transfer belt 7 toward the photosensitive drum 1, so that a primary transfer portion (primary transfer nip) N1 is formed where the photosensitive drum 1 and the intermediary transfer belt 7 contact each other. The toner image formed on the photosensitive drum 1 is transferred (primary transferred) onto the intermediary transfer belt 7 as a toner image receiving member, at the primary transfer portion N1, rotating (circulating and moving) in an arrow R direction (clockwise direction) in FIG. 1. During a primary transfer step, to the primary transfer roller 5, a primary transfer voltage (primary transfer bias), which is a DC voltage of an opposite polarity to the charge polarity of the toner during the development, is applied. For example, during full color image formation, the respective color toner images of yellow, magenta, cyan and black formed on the respective photosensitive drums 1 are successively transferred superposedly onto the intermediary transfer belt 7.

At a position opposing the secondary transfer opposite roller 73 on an outer peripheral surface side of the intermediary transfer belt 7, a secondary transfer roller 8 which is a roller-type secondary transfer member as a secondary transfer means is provided. The secondary transfer roller 8 is (pressed (urged) against the intermediary transfer belt 7 toward the secondary transfer opposite roller 73 and forms a secondary transfer portion (secondary transfer nip) N2 where the intermediary transfer belt 7 and the secondary transfer roller 8 are in contact with each other. The toner images formed on the intermediary transfer belt 7 as described above are transferred (secondary-transferred) onto the recording material P, such as paper as a toner image receiving member, nipped and fed at the secondary transfer portion N2 by the intermediary transfer belt 7 and the secondary transfer roller 8. During a secondary transfer step, to the secondary transfer roller 8, a secondary transfer voltage (secondary transfer bias) which is a DC voltage of an opposite polarity to the normal charge polarity of the toner during is applied. The recording material P is accommodated in a recording material cassette (not shown) and is fed to a registration roller pair 9 by a pick-up roller and a feeding roller (which are not shown). Then, the recording material P is supplied to the secondary transfer portion N2 while being timed to the toner images on the intermediary transfer belt 7 by the registration roller pair 9.

The recording material P on which the toner images are transferred is fed to a fixing device 10 as a fixing means and is heated and pressed by the fixing device 15, and thereafter is discharged (outputted) to an outside of an apparatus main assembly 110 of the image forming apparatus 100.

Toner (residual toner) remaining on the surface of the photosensitive drum 1 after the primary transfer step is removed and collected from the surface of the photosensitive drum 1 by the cleaning device 6 as a photosensitive member cleaning means. Further, toner (residual toner) remaining on the surface of the intermediary transfer belt 7 after a secondary transfer step is removed and collected from the surface of the intermediary transfer belt 7 by a belt cleaning device 74 as an intermediary transfer member cleaning means.

Figure 2:
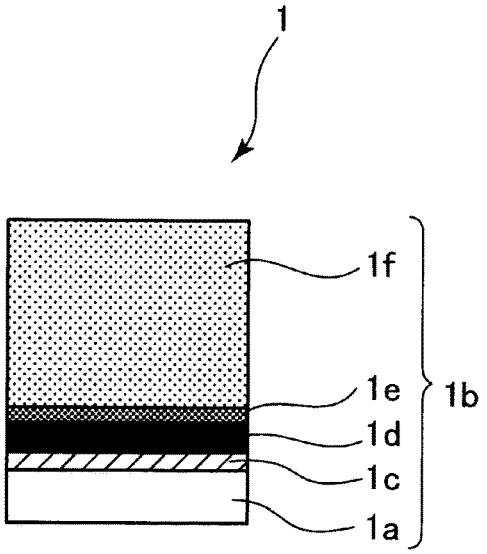
FIG. 2 is a schematic sectional view of a photosensitive drum.

In this embodiment, as shown in FIG. 2, the position 1 is constituted by an aluminum cylinder (aluminum bare tube) 1*a*, as an electroconductive base material, of 30 mm in outer diameter and an about 20-50 μm thick OPC (organic photoconductor) as a photosensitive layer 1*b* applied onto an outer peripheral surface of the aluminum cylinder 1*a*. In this embodiment, the photosensitive layer 1*b* is constituted by laminating, on the cylinder 1*a*, an undercoat layer (UC layer) 1*c*, a charge-injection preventing layer (CP layer) 1*d*, a charge generating layer (CG layer) 1*e* and a charge transporting layer (CT layer) 1*f* in a named order. The undercoat layer 1*c* has a function of improving an adhesive property. The charge-injection preventing layer 1*d* has a function of preventing charge injection from the cylinder 1*a*. The charge generating layer 1*e* has a function of generating positive and negative electric charges when the photosensitive layer is irradiated with light. The charge transporting layer 1*f* has a function of transporting the positive electric charge generated in the charge generating layer 1*e*. In this embodiment, as regards film thicknesses of the respective functional layers of the photosensitive layer 1*b*, as representative values, the under coat layer 1*c* is 20 μm, the charge-injection preventing layer 1*d* is 1 μm, the charge generation layer 1*e* is 1 μm and the charge transporting layer 1*f* is 20 μm.

In this embodiment, the developing device 4 uses, as a developer, a two-component developer containing non-magnetic toner particles (toner) and magnetic carrier particles (carrier). To the toner, as an external additive, silica or the like can be externally added. In this embodiment, an average charge amount (charge amount per unit weight) of the toner is $-1.0\times10^{-2}$ C/kg to $-6.0\times10^{-2}$ C/kg. Into the developing device 4, the toner in an amount corresponding to an amount of the toner consumed by a developing operation is supplied from a toner supplying container 12 provided so as to be detachably mountable to the apparatus main assembly 110.

In this embodiment, the intermediary transfer belt 7 is formed with an endless film molded with a polyimide resin material in a thickness of 100 μm. When the thickness of the intermediary transfer belt 7 is less than 50 μm, sufficient durability cannot be obtained due to abrasion in some instances, and when the thickness of the intermediary transfer belt 7 exceeds 50 μm, the intermediary transfer belt 7 is not readily properly curved by a supporting shaft and thus is not stably moved in some instances. Further, into a material of the intermediary transfer belt 7, an electroconductive agent such as carbon black for adjusting an electric resistance value is added. In this embodiment, resistance values of the intermediary transfer belt 7 are adjusted to $1.0\times10^{10}$ Ω·cm in volume resistivity and $6.0\times10^{11}$ Ω/□ in surface resistance. In this embodiment, the intermediary transfer belt 7 having a single layer structure was used, but an intermediary transfer belt 7 having a plural layer structure including a substrate formed of the same material as the above-described material and an elastic layer formed on the substrate may also be used.

Figure 3:
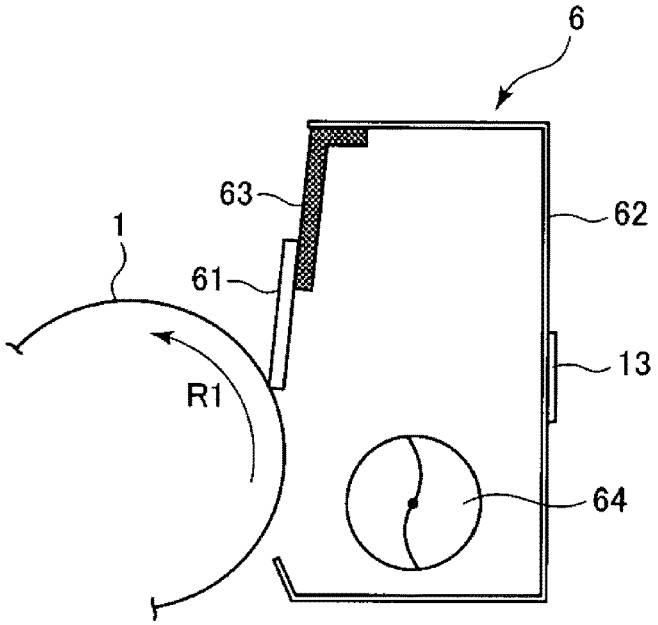
FIG. 3 is a schematic sectional view of a cleaning device.

In this embodiment, as shown in FIG. 3, the cleaning device 6 includes a cleaning blade 61 as a cleaning member provided in contact with the photosensitive drum 1 and a cleaning container 62. Further, the cleaning device 6 includes a metal plate 63 as a supporting member fixed to the cleaning container 62 and supporting the cleaning blade and a feeding screw 64 provided in the cleaning container 62 and used as a feeding member. The cleaning device 6 scrapes off residual toner from the surface of the rotating photosensitive drum 1 by the cleaning blade 61 and accommodates the residual toner in the cleaning container 62. The residual toner accommodated in the cleaning container 62 is sent by the feeding screw 64 to a collecting container (not shown) provided so as to be detachably mountable to the apparatus main assembly 110.

In this embodiment, the cleaning blade 61 is a plate-like (blade-like) member formed of polyurethane (urethane rubber) which is an example of an elastic material. It is also possible to employ, other than the polyurethane, a styrene-butadiene copolymer, chloroprene, butadiene rubber, ethylene-propylene-diene-based rubber, chlorosulfonated polyethylene rubber, fluorine-containing rubber, silicone rubber, and the like.

In this embodiment, the cleaning blade 61 is formed by molding in a size of 340 mm in longitudinal length, 15 mm in widthwise length and 2 mm in thickness, and a length (free length) of a portion, with respect to a widthwise direction, which is not supported by the metal plate 63 is 8 mm. The cleaning blade 61 is disposed so that a longitudinal direction thereof is substantially parallel to a longitudinal direction (rotational axis direction) of the photosensitive drum 1. Further, a longitudinal length of the cleaning blade 61 is longer than an image forming region (toner image formable region) with respect to the longitudinal direction of the photosensitive drum 1, so that the image forming region falls within the longitudinal length of the cleaning blade 61. The cleaning blade 61 is contacted to the photosensitive drum 1 at an edge portion thereof, i.e., so that a free end thereof faces toward an upstream side of the rotational direction of the photosensitive drum 1. Further, the cleaning blade 61 is mounted to the cleaning container 62 by the metal plate 63 in a state in which the cleaning blade 61 is urged so as to provide a predetermined entering amount into the photosensitive drum 1.

In this embodiment, a belt cleaning device 74 removes and collects the residual toner from the surface of the intermediary transfer belt 7 by a belt cleaning blade 74*a* as a cleaning member provided in contact with the intermediary transfer belt 7. The belt cleaning blade 74*a* is urged against the intermediary transfer belt 7 toward the tension roller 72. As the belt cleaning blade 74*a*, a member similar to that of the cleaning blade 61 of the cleaning device 6 can be used.

In this embodiment, at each of the image forming portions S, the photosensitive drum 1, the charging roller 2 and the cleaning device 6 integrally constitute a process cartridge (drum cartridge) detachably mountable to the apparatus main assembly 110. Further, at each of the image forming portions S, the developing device 4 constitutes a developing cartridge detachably mountable to the apparatus main assembly 110.

In this embodiment, a toner image forming means for forming the toner image on the photosensitive drum 1 is constituted by the charging roller 2, the exposure device 3 and the developing device 4.

2. Contact Pressure Information

In this embodiment, a lifetime of the photosensitive drum 1 is estimated on the basis of contact pressure information of the cleaning blade 61 of the cleaning device 6 to the photosensitive drum 1.

For that reason, in this embodiment, during assembling of a process cartridge 11, contact pressure of the blade 61 to the photosensitive drum 1 (hereinafter, this contact pressure is also referred to as "blade pressure") is measured. In this embodiment, blade pressure in each of five regions equally divided from the blade 61 with respect to the longitudinal direction (hereinafter, this blade pressure is also referred to as "partial blade pressure") is measured. Then, of these measured partial pressure values, information on the largest partial blade pressure value (hereinafter, this information is also referred to as "partial pressure information") is indicated on a seal 13 (FIG. 3), and the seal 13 is applied onto the process cartridge 11. Thus, in this embodiment, the partial blade pressure value as the partial pressure information is indicated on the seal 13. Further, the seal 13 on which the partial pressure information is indicated is applied onto the process cartridge 11 before shipping of the process cartridge 11 (for example, subsequent to the measurement of the partial blade pressure during assembling). Here, the above described partial pressure information is an example of the contact pressure information on the contact pressure of the cleaning member to the photosensitive member. Further, the seal 13 is an example of an indicating portion on which the contact pressure information of the process cartridge 11 is indicated. Further, the indicating portion is an example of an information holding means in which the contact pressure information of the process 11 is held (stored).

The blade pressure can be measured in the following manner in a state in which the photosensitive drum 1 is not incorporated into the process cartridge 11 (but the blade 61 is incorporated into the process cartridge 11). For measuring the partial blade pressure, a measuring device (jig) including a supporting member for supporting the process 11 and phantom drums corresponding to the photosensitive drums 1 can be used. In this measuring device, five cylindrical phantom drums of 50 mm in width are developed in the longitudinal direction with intervals of 5 mm. With these cylindrical phantom drums, a load cell for measuring an applied load is connected. Then, the process cartridge 11 supported by the supporting member is pressed against the phantom drums, and the load applied by the blade 61 is detected by the load cell. As a result, the contact pressure of the blade 61 to each of the phantom drums, i.e., the partial blade pressure of the blade 61 in each of the five regions with respect to the longitudinal direction can be measured.

As regards the blade pressure, a variation generates for each of individual cleaning devices 6 (individual process cartridges 11) or for each of production lots of the cleaning device 6 (process cartridge 11) in some instances. This variation can generate due to a manufacturing variation, of the blade alone, such as a physical property, a thickness, a free length dimension or the like of a rubber material of the blade 61. Further, the variation can also generate due to a position, an adhesive condition and the like when the rubber material of the blade 61 is bonded to the metal plate 63. Further, with a higher blade pressure value, a frictional force between the blade 61 and the photosensitive drum 1 becomes larger and thus the surface of the photosensitive layer 1*b* of the photosensitive drum 1 is abraded in a larger amount and is liable to be damaged, so that a lifetime of the photosensitive drum 1 becomes shorter. Further, the blade pressure varies also depending on a longitudinal position of the blade for the same reason as described above in some cases. For that reason, from the same reason as described above, the lifetime of the photosensitive drum 1 varies also depending on the longitudinal position of the blade 61 in some cases.

Accordingly, in this embodiment, information (partial pressure information) on the largest blade pressure value among the measured partial blade pressure values is indicated on the seal 13. Further, on the basis of this partial pressure information, the lifetime of the photosensitive drum 1 is estimated in the apparatus main assembly 110 side, and proper exchange timing of the process cartridge 11 is capable of being notified to an operator.

The measurement of the blade pressure can be carried out every unit for which there is a possibility of generation of the variation in blade pressure having the influence on the discrimination of the lifetime of the photosensitive drum 1. For example, the blade pressure measurement can be carried out every individual blade 61 (process cartridge 11), every production lot of the blade 61 (process cartridge 11), or the like. In the case of measuring the blade pressure measurement every production lot, by using a representative constituent part of the process cartridge 11, the blade pressure is measured. In the case where the representative constituent part is used, blade pressure measured using a pair of constituent parts may be used or an average of blade pressure values measured using a plurality of pairs of constituent parts may also be used. In this embodiment, the measurement of the blade pressure is carried out every blade 61 (process cartridge 11).

In this embodiment, the blade 61 was divided into the five regions with respect to the longitudinal direction and the blade pressure in each of the five regions was measured, but the present invention is not limited thereto. The number of the divided regions may also be increased and decreased. However, the number of the divided regions may preferably be large since accuracy of lifetime estimation of the photosensitive drum 1 can be enhanced. Typically, the number of the divided regions may suitably be about 3-10 (regions). Further, in the case where the variation in contact pressure of the blade 61 with respect to the longitudinal direction is relatively small or in the like case, an average of contact pressure values with respect to the longitudinal direction, a representative value at an arbitrary position with respect to the longitudinal direction or a sum of contact pressure values in a plurality of regions with respect to the longitudinal direction may also be used.

3. Notification of Lifetime of Photosensitive Drum

Next, a method of notifying the lifetime of the photosensitive drum 1 in this embodiment will be described.

In this embodiment, when an operator such as a user or a service person exchanges the process cartridge 11 with respect to the apparatus main assembly 110, the operator reads partial pressure information indicated on a seal 13 applied onto a process cartridge 11 to be newly mounted in the apparatus main assembly 110. Further, the operator inputs the read partial pressure information into the apparatus main assembly 110. Then, in the apparatus main assembly 110 side, a process cartridge for notifying the operator of the information on the lifetime of the photosensitive drum 1 is carried out.

Specifically, in this embodiment, in the apparatus main assembly 110 side, an estimate lifetime of the photosensitive drum 1 is acquired on the basis of the inputted partial pressure information. In this embodiment, as the estimate lifetime of the photosensitive drum 1, an index value indicating timing when the photosensitive drum 1 reaches an end of the lifetime thereof (i.e., exchange timing of the process cartridge 11) is acquired. Particularly, in this embodiment, as the index value, the number of images capable of being formed using the photosensitive drum 1 (process cartridge 11) (hereinafter also referred to as an "image formable sheet number") is acquired. Further, in this embodiment, in the apparatus main assembly 110 side, the exchange timing of the process cartridge 11 is stored, and when the exchange timing arrives, display prompting the exchange of the photosensitive drum 1 (process cartridge 11) is produced. This will be specifically described.

Figure 4:
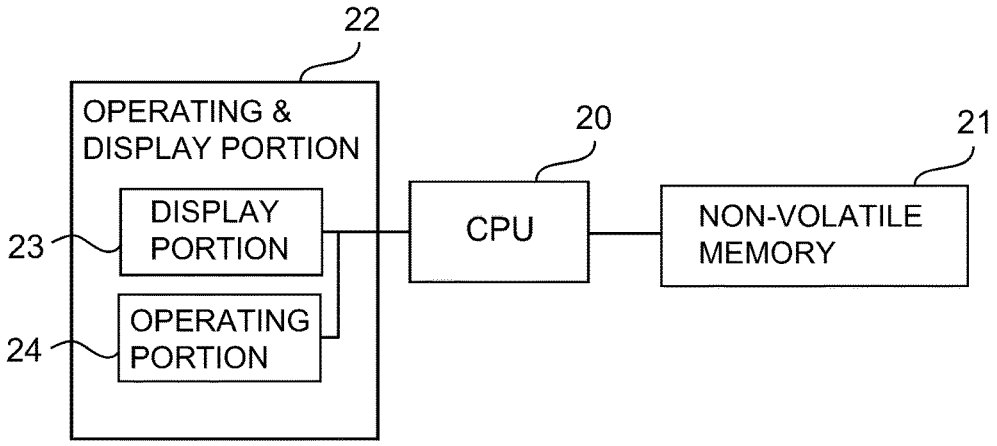
FIG. 4 is a block diagram showing a general control in an embodiment.
Figure 5:
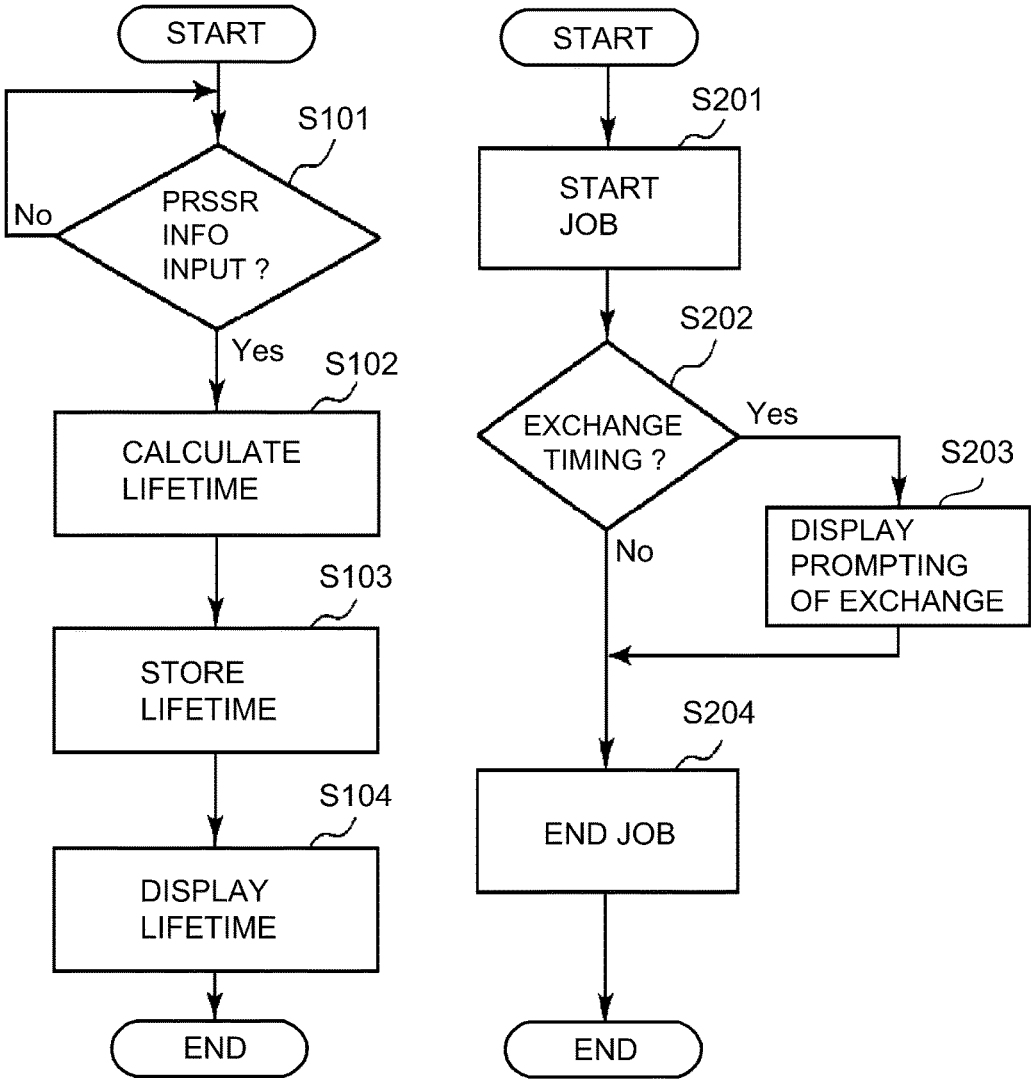
FIG. 5 is a flowchart showing an outline of a procedure of a process for notifying a lifetime of the photosensitive drum.

FIG. 4 is a block diagram showing a schematic control mode of the image forming apparatus 100 in which attention is given to the process for notifying the lifetime of the photosensitive drum 1 in this embodiment. FIG. 5 is a flowchart schematically showing a procedure of the process for notifying the lifetime of the photosensitive drum 1.

In this embodiment, a CPU 20 as a controller provided in the apparatus main assembly 110 effects integrated control of operations of respective portions of the image forming apparatus 100. The CPU 20 carries out the control by using a program and data stored in a nonvolatile memory 21 as a storing portion provided in the apparatus main assembly 110. To the CPU 20, an operating and displaying portion (operation panel) 22 provided in the apparatus main assembly 110 is connected. The operating and displaying portion 22 includes a display portion 23 as a displaying means for displaying the information and an operating portion 24 as an inputting means for inputting the information into the controller 20. In this embodiment, the CPU 20 has a function of not only executing a process for calculating exchange timing of the process cartridge 11 and causing the display portion 23 to display the exchange timing and arrival of the exchange timing but also as a counting means for counting the number of images formed every image formation. In this embodiment, the number of images is subjected as a value, converted into the number of images in a predetermined size (e.g., A4 size), to the process cartridge.

In the nonvolatile memory 21, information (Table 1) indicating a relationship between the partial pressure information and the image formable sheet number as described later is stored. When the process cartridge 11 is exchanged, the partial pressure information indicated on the seal 13 applied to the process cartridge 11 to be newly mounted in the apparatus main assembly 110 is inputted by the operator through the operating portion 24. The inputted partial pressure information is sent to the CPU 20 (S101). On the basis of the information (Table 1) showing the above-described relationship stored in the nonvolatile memory 21, the CPU 20 calculates an estimate lifetime of the photosensitive drum 1 as the image formable sheet number indicating the exchange timing of the process cartridge 11 (S102). Thereafter, the CPU 20 stores a calculation result in the nonvolatile memory 21 (S103). Further, the CPU 20 causes the display portion 23 to display the calculation result (S104). As a result, the operator can recognize exchange timing of a next process cartridge 11 during the exchange of the current process cartridge 11.

Further, when a job (a series of operations for forming and outputting images on a single recording material P or a plurality of recording materials P by a single start instruction) is executed, the CPU 20 renews and stores a cumulative image forming sheet number in the nonvolatile memory 21 for each image formation (S201). This cumulative image forming sheet number is reset to zero when the process cartridge 11 is exchanged. Further, the CPU 20 can recognize the exchange of the process cartridge 11 by, for example, input of the partial pressure information or detection of mounting of a new process cartridge 11 by a new process cartridge detecting means provided separately. Then, the CPU 20 compares, every renewal of the cumulative image forming sheet number, the cumulative image forming sheet number with the image formable sheet number stored in the nonvolatile memory 21, and discriminates whether or not the cumulative image forming sheet number reaches the image formable sheet number (S202). That is, the CPU 20 discriminates whether or not the exchange timing of the photosensitive drum 1 (process cartridge 11) arrives. Then, in the case where the cumulative image forming sheet number reached the image formable sheet number, the CPU 20 causes the display portion 23 to display a message (guiding display, warning display) prompting the exchange of the process cartridge 11 (S203). As a result, the operator can recognize that the exchange timing of the process cartridge 11 arrived. Thereafter, the CPU 20 ends the job in the case where formation of all of the images in the job has already been ended, and in the case where the formation of all of the images in the job is not ended, the CPU 20 interrupts the job and then can resume the job after the process cartridge 11 is exchanged (S204).

Table 1 shows a relationship between the partial blade pressure and the estimate lifetime (image formable sheet number indicating the exchange timing of the process cartridge 11) in this embodiment. In this embodiment, information (table) showing this relationship is acquired and stored in the nonvolatile memory 21 in advance. The CPU 20 can acquire the estimate lifetime of the photosensitive drum 1 corresponding to the partial pressure information by making reference to the information (table). In the case where the inputted partial blade pressure is a numerical value which is not listed in Table 1, the CPU 20 calculates the estimate lifetime of the photosensitive drum 1 by subjecting the inputted partial blade pressure value to linear interpolation using adjacent two values between which the inputted partial blade pressure value exists. For example, in the case where the partial blade pressure at a certain position of the cleaning blade 61 with respect to the longitudinal direction is 180 gf, this value is subjected to linear interpolation between 150 gf and 200 gf in Table 1, so that the estimate lifetime of the photosensitive drum 1 can be acquired as 146 k (=$10^3$) sheets. In this embodiment, the lifetime of the photosensitive drum 1 indicated by the information notified by the above-described process is shorter when the contact pressure is second contact pressure larger than first contact pressure than when the contact pressure is the first contact pressure.

TABLE 1

| PPCB*1 (gf) | ELPD*2 (k sheets) |
|---|---|
| 50 | 200 |
| 100 | 190 |
| 150 | 170 |
| 200 | 130 |
| 250 | 90 |
| 300 | 50 |

*1"PPCB" is the partial pressure of the cleaning blade.
*2"ELPD" is the estimate lifetime of the photosensitive drum.

Thus, on the basis of the contact pressure information actually measured during assembling of the process cartridge 11, the estimate lifetime of the photosensitive drum 1 is acquired every process cartridge 11, so that it becomes possible to notify the exchange timing with high accuracy.

Incidentally, this embodiment is also applicable to notification of a lifetime of the intermediary transfer belt 7 which is the second image bearing member. That is, the surface of the intermediary transfer belt 7 is rubbed with the belt cleaning blade 74*a* with image formation, and therefore, the intermediary transfer belt 7 is gradually deteriorated in some instances. Then, the frictional force becomes larger with a larger contact pressure of the belt cleaning blade 74*a* to the intermediary transfer belt 7, and therefore the intermediary transfer belt 7 is liable to deteriorate. Accordingly, similarly as in this embodiment, the exchange timing of the intermediary transfer belt 7 can be properly notified by notifying of the information on the lifetime of the intermediary transfer belt 7 on the basis of the information on the contact pressure of the belt cleaning blade 74*a* to the intermediary transfer belt 7. In this case, the respective image forming portions S constitute the toner image forming means for forming the toner images on the intermediary transfer belt 7.

Embodiment 2

Next, another embodiment of the present invention will be described. A basic constitution and an operation of an image forming apparatus in this embodiment are the same as those in Embodiment 1. Accordingly, in the image forming apparatus in this embodiment, elements having the same or corresponding functions and constitutions as those in Embodiment 1 are represented by the same reference numerals or symbols and will be omitted from description.

In this embodiment, the lifetime of the photosensitive drum 1 is estimated on the basis of initial film thickness information on an initial film thickness which is a film thickness of the photosensitive layer 1*b* in an initial stage of use (in an unused state) of the photosensitive drum 1.

The lifetime of the photosensitive drum 1 is determined depending on a lower limit of the film thickness of the photosensitive layer 1*b* necessary to form the image by using the photosensitive drum 1 (hereinafter, the lower limit is referred to as a "necessary remaining film thickness"). For example, when the film thickness of the charge transporting layer 1*f* is 10 μm or less, a charge transporting performance becomes insufficient and improper charging generates, so that the image cannot be properly formed in some instances. In this embodiment, the film thickness of the charge transporting layer 1*f* necessary to form the image is 10 μm. Further, in this embodiment, the necessary remaining film thickness of the photosensitive layer 1*b* including the under coat layer 1*c*, the charge injection preventing layer 1*d*, the charge generating layer 1*e* and the charge transporting layer 1*f* which are coated on the aluminum cylinder 1*a* is 32 μm.

As regards the initial film thickness of the photosensitive layer 1*b* of the photosensitive drum 1, for a manufacturing reason or the like, a variation generates in some instances, for example, every individual photosensitive drum 1 (process cartridge 11) or every production lot of the photosensitive drum 1 (process cartridge 11). As described above, the lifetime of the photosensitive drum 1 varies depending on a variation in initial film thickness of the photosensitive layer 1*b*. That is, with a smaller initial film thickness of the photosensitive layer 1*b*, the photosensitive drum 1 is more abraded and a usable amount (rotation time or the number of rotations) of the photosensitive drum 1 until the photosensitive layer film thickness reaches the necessary remaining film thickness becomes smaller, so that the lifetime of the photosensitive drum 1 is shortened. Further, in some cases, the initial film thickness of the photosensitive layer 1*b* of the photosensitive drum 1 also varies depending on a position of the photosensitive drum 1 with respect to the longitudinal direction. For that reason, the lifetime of the photosensitive drum 1 can vary also depending on the position of the photosensitive drum 1 with respect to the longitudinal direction.

Therefore, in this embodiment, the initial film thickness of the photosensitive layer 1*b* of the photosensitive drum 1 is measured during assembling of the process cartridge 11. The initial film thickness of the photosensitive layer 1*b* of the photosensitive drum 1 can be measured in the following manner, for example, before the photosensitive drum 1 is assembled into the process cartridge 11. As an initial film thickness measuring method, for example, there is a film thickness measuring method of an eddy current type. In this method, a probe in which a coil is provided is contacted to an object (to be measured), whereby excitation is caused by the coil, so that an eddy current flows. A magnetic field is generated by this eddy current, and a magnitude thereof is correlated with the object and a distance (film thickness) from the probe, and therefore, the magnitude can be converted into the film thickness of the photosensitive layer 1*b*. Accordingly, before the film thickness of the photosensitive layer 1*b* of an objective photosensitive drum 1 is measured, calibration is performed in advance by using the aluminum cylinder and a sheet for which the film thickness has been accurately determined. Thereafter, when the film thickness of the photosensitive layer 1*b* of the photosensitive drum 1 is measured, it is possible to acquire the initial film thickness with accuracy.

In this embodiment, the initial film thickness of the photosensitive layer 1*b* is measured at five positions with respect to the longitudinal direction. Then, of these measured initial film thicknesses, information on a smallest initial film thickness (hereinafter, this information is also referred to as "initial film thickness information") is indicated on a seal 13, and the seal 13 is applied onto the process cartridge 11. Thus, in this embodiment, the initial film thickness value as the initial film thickness information is indicated on the seal 13. Further, the seal 13 on which the initial film thickness information is indicated is applied onto the process cartridge 11 before shipping of the process cartridge (for example, subsequent to the assembling of the photosensitive drum 1). Here, the seal 13 is an example of an indicating portion on which the initial film thickness information of the process cartridge 11 is indicated. Further, the indicating portion is an example of an information holding means in which the initial film thickness information of the process cartridge 11 is held (stored).

In this embodiment, at each of the five measuring positions, the initial film thickness is continuously measured five times, and an average thereof is calculated. This operation is performed at each of four circumferential positions which are located in the same longitudinal direction but which are deviated from each other by 90° with respect to a circumferential direction. Then, an average of average values at the four circumferential positions is used as a representative value of the initial film thickness at one of the five longitudinal positions of the photosensitive drum 1. This operation is similarly performed at the five longitudinal positions in total. However, the number of measuring positions and the number of positions where averaging is made can be selected appropriately and freely depending on desired measurement accuracy. In the case where a variation in film thickness of the photosensitive layer 1*b* of the photosensitive drum 1 is relatively small with respect to the longitudinal direction, an average of film thickness values with respect to the longitudinal direction, a representative value of the film thickness values at an arbitrary position with respect to the longitudinal direction, or the like may also be used.

The measurement of the initial film thickness can be carried out every unit for which there is a possibility of generation of the variation in initial film thickness having the influence on the discrimination of the lifetime of the photosensitive drum 1. For example, the initial film thickness measurement can be carried out every individual photosensitive drum 1 (process cartridge 11), every production lot of the photosensitive drum 1 (process cartridge 11), or the like. In the case of measuring the initial film thickness measurement every production lot, by using a representative photosensitive drum 1, the blade pressure is measured. The representative photosensitive drum 1 may be a single photosensitive drum, and an average of initial film thickness values measured using a plurality of representative photosensitive drums 1 may also be used. In this embodiment, the measurement of the initial film thickness is carried out every photosensitive drum 1 (process cartridge 11).

Table 2 shows a relationship between the initial film thickness information and the estimate lifetime (image formable sheet number indicating the exchange timing of the process cartridge 11) in this embodiment. In this embodiment, information (table) showing this relationship is acquired and stored in the nonvolatile memory 21 in advance. The CPU 20 can acquire the estimate lifetime of the photosensitive drum 1 corresponding to the initial film thickness information by making reference to the information (table). In the case where the inputted initial film thickness is a numerical value which is not listed in Table 2, the CPU 20 calculates the estimate lifetime of the photosensitive drum 1 by subjecting the inputted initial film thickness value to linear interpolation using adjacent two values between which the inputted partial blade pressure value exists. For example, in the case where the initial film thickness at a certain position of the photosensitive drum 1 with respect to the longitudinal direction is 42.8 μm, this value is subjected to linear interpolation between 42.5 μm and 43.0 μm in Table 2, so that the estimate lifetime of the photosensitive drum 1 can be acquired as 156.4 k ($=10^3$) sheets.

TABLE 2

| FTPD*1 (gf) | ELPD*2 (k sheets) |
|---|---|
| 41.0 | 142 |
| 41.5 | 146 |
| 42.0 | 150 |
| 42.5 | 154 |
| 43.0 | 158 |

*1"FTPD" is the film thickness of the photosensitive drum.
*2"ELPD" is the estimate lifetime of the photosensitive drum.

In this embodiment, by a procedure similar to that described in Embodiment 1 with reference to FIG. 5, the process of notifying the lifetime of the photosensitive drum 1 is carried out. However, in this embodiment, in S101, the initial film thickness information indicated on the seal 13 is inputted. Further, in S102, on the basis of the information (Table 2) showing the relationship, between the initial film thickness information and the image formable sheet number, stored in the nonvolatile memory 21, the estimate lifetime (exchange timing of the process cartridge 11) of the photosensitive drum 1 is calculated.

In this embodiment, the lifetime of the photosensitive drum 1 indicated by the information notified by this process is shorter when the initial film thickness is a second film thickness smaller than a first film thickness than when the initial film thickness is the first film thickness.

Thus, on the basis of the initial film thickness information actually measured during assembling of the process cartridge 11, the estimate lifetime of the photosensitive drum 1 is acquired every process cartridge 11, so that it becomes possible to notify the exchange timing with high accuracy.

Embodiment 3

Next, another embodiment of the present invention will be described. A basic constitution and an operation of an image forming apparatus in this embodiment are the same as those in Embodiments 1 and 2. Accordingly, in the image forming apparatus in this embodiment, elements having the same or corresponding functions and constitutions as those in Embodiments 1 and 2 are represented by the same reference numerals or symbols and will be omitted from description.

In this embodiment, the lifetime of the photosensitive drum 1 is estimated on the basis of the contact pressure information and the initial film thickness information.

As described above, with a larger blade pressure, a frictional force between the photosensitive drum 1 and the blade 61 becomes larger, and therefore the lifetime of the photosensitive drum 1 becomes shorter. On the other hand, as described above, the lifetime of the photosensitive drum 1 is determined by the necessary remaining film thickness of the photosensitive layer 1*b*, and with a thinner initial film thickness of the photosensitive layer 1*b*, the lifetime of the photosensitive drum 1 becomes shorter. Accordingly, by estimating the lifetime of the photosensitive drum 1 on the basis of the contact pressure information and the initial film thickness information, the lifetime of the photosensitive drum 1 can be estimated with higher accuracy than the case of estimating the lifetime of the photosensitive drum 1 on the basis of either one of the contact pressure information and the initial film thickness information.

Table 3 shows a relationship between the partial pressure information and an abrasion rate of the photosensitive drum 1. The abrasion rate represents a rate of a film thickness decreasing amount (abrasion amount) of the photosensitive layer 1*b* of the photosensitive drum 1 per 10 k sheets as the image forming sheet number. The abrasion rate is an example of a photosensitive layer film thickness decreasing amount relative to an amount of use of the photosensitive member.

TABLE 3

| PPCB*1 (gf) | ARPD*2 (μm/10 k sheets) |
|---|---|
| 50 | 0.50 |
| 100 | 0.53 |
| 150 | 0.59 |
| 200 | 0.77 |
| 250 | 1.11 |
| 300 | 2.00 |

*1"PPCB" is the partial pressure of the cleaning blade.
*2"ARPD" is the abrasion rate of the photosensitive drum.

The lifetime of the photosensitive drum 1 can be represented by dividing an abrasion tolerable film thickness described later by the abrasion rate acquired from Table 3 in the following manner. Similarly as in the case of Embodiment 1, when the blade pressure is a numerical value which is not listed in Table 3, the CPU 20 can calculate the abrasion rate by subjecting the numerical value to linear interpolation using adjacent two values between which the numerical value exists.

$$\text{(Lifetime of photosensitive drum)}=((\text{abrasion tolerable film thickness})\times 10)/(\text{abrasion rate}) \quad (1)$$

The abrasion tolerable film thickness can be represented by subtracting the necessary remaining film thickness from the initial film thickness as follows.

$$\text{(Abrasion tolerable film thickness)}=(\text{initial film thickness})-(\text{necessary remaining film thickness}) \quad (2)$$

In this embodiment, similarly as in the case of Embodiment 2, the necessary remaining film thickness is 32 μm. For example, the case where the blade pressure of the blade 61 at a certain longitudinal position is 180 gf and the initial film thickness of the photosensitive drum 1 at a position corresponding to the blade position is 42.5 μm will be considered. In this case, the blade pressure of 180 gf is subjected to linear interpolation between 150 gf and 200 gf in Table 3, so that the abrasion rate can be acquired as about 0.70 μm/10 k sheets. Further, in this embodiment, the necessary remaining film thickness is 32 μm, and from the above formula (2), the abrasion tolerable film thickness can be calculated as 10.5 μm. Accordingly, from the above formula (1), the lifetime of the photosensitive drum 1 can be acquired as 150 k sheets.

In this embodiment, in each of the five longitudinal regions in which the blade pressure is measured, an associated one of the five longitudinal positions of the photosensitive drum 1 where the initial film thickness is measured is included. On the seal 13, five pieces of the partial pressure information of the blade 61 at the five longitudinal positions (regions) are indicated. Further, on the seal 13, five pieces of the initial film thickness information of the photosensitive drum 1 at the five longitudinal positions corresponding to the five longitudinal positions, respectively, of the blade 61 are indicated in a correspondence manner. Then, the five pieces of the partial pressure information and the five pieces of the initial film thickness information are associated with each other and are inputted into the controller 20. As a result, in this embodiment, as described above, the lifetime of the photosensitive drum 1 is calculated at the five positions with respect to the longitudinal direction of each of the blade 61 and the photosensitive drum 1. Further, in this embodiment, of the lifetime values of the photosensitive drum 1 at the five positions, a shortest lifetime is used as the estimate lifetime (exchange timing of the process cartridge 11) of the photosensitive drum 1.

In this embodiment, by a procedure similar to that described in Embodiment 1 with reference to FIG. 5, the process of notifying of the lifetime of the photosensitive drum 1 is carried out. However, in this embodiment, in S101, the five pieces of the partial pressure information and the five pieces of the initial film thickness which are information indicated on the seal 13 are inputted. Further, in S102, on the basis of the information (Table 2) showing the relationship, between the partial pressure information and the abrasion rate, stored in the nonvolatile memory 21 and the above described formulas (1) and (2), the estimate lifetime (exchange timing of the process cartridge 11) of the photosensitive drum 1 is calculated. In this embodiment, when the initial film thickness is the same, the lifetime of the photosensitive drum 1 indicated by the information notified by this process is shorter when the contact pressure is second contact pressure larger than first contact pressure than when the contact pressure is the first contact pressure. Further, when the contact pressure is the same, the lifetime of the photosensitive drum 1 indicated by the information notified by this process is shorter when the initial film thickness is second film thickness smaller than first film thickness than when the initial film thickness is the first film thickness.

Thus, by using the contact pressure information and the initial film thickness information, it is possible to notify the exchange timing of the process cartridge 11 with higher accuracy than those in Embodiments 1 and 2.

Embodiment 4

Next, another embodiment of the present invention will be described. A basic constitution and an operation of an image forming apparatus in this embodiment are the same as those in Embodiments 1 to 3. Accordingly, in the image forming apparatus in this embodiment, elements having the same or corresponding functions and constitutions as those in Embodiments 1 to 3 are represented by the same reference numerals or symbols and will be omitted from description.

In this embodiment, an IC tag is attached to the process cartridge 11, and in this IC tag, the contact pressure information and the initial film thickness information which are described in Embodiments 1 to 3 are stored. Then, when the process cartridge 11 is mounted in the apparatus main assembly 110, necessary information is automatically read in the apparatus main assembly 110 side, and then proper exchange timing of the process cartridge 11 is notified. In the case where the operator inputs the contact pressure information or the initial film thickness information, there is a possibility that information to be inputted is erroneously inputted. On the other hand, in the case where the contact pressure information and the initial film thickness information are automatically read from the IC tag, erroneous input of the information can be prevented, and a load on the operator can be alleviated by saving time and effort to input the information by the operator.

Figure 6:
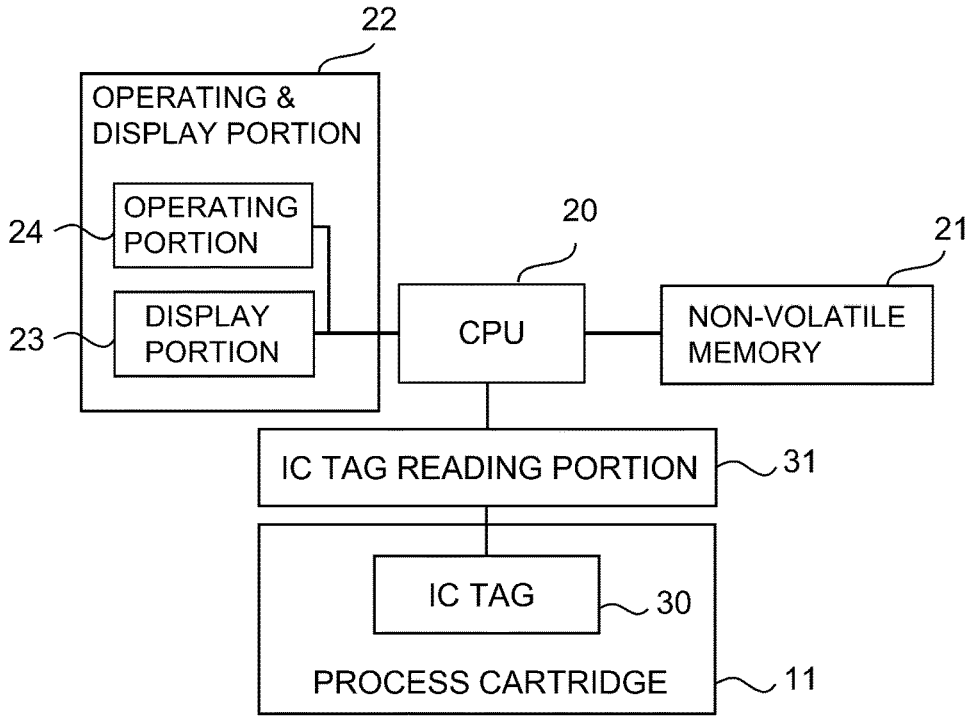
FIG. 6 is a block diagram showing control in another embodiment.

FIG. 6 is a block diagram showing a schematic control mode of the image forming apparatus 100 in which attention is given to a process for notifying the lifetime of the photosensitive drum 1 in this embodiment. In this embodiment, an IC tag 30 including a nonvolatile memory as a storing medium is mounted to the process cartridge 11. Before shipping (during assembly or the like) of the process cartridge 11, the contact pressure information and the initial film thickness information are stored in the IC tag 30. Then, when the operator mounts the process cartridge 11 in the apparatus main assembly 110, the IC tag 30 is connected with an IC tag reading portion 31 provided in the apparatus main assembly 110. As a result, the contact pressure information and the initial film thickness information are read from the IC tag 30 by the IC tag reading portion 31 and are sent to the CPU 20.

In this embodiment, the CPU 20 executes the process of notifying the lifetime of the photosensitive drum 1 in the same procedure as those in Embodiments 1 to 3 except that the information sent from the IC tag reading portion 31 is used in place of the information inputted from the operating portion 24 in Embodiments 1 to 3. That is, the CPU 20 calculates the estimate lifetime of the photosensitive drum 1 on the basis of the information stored in the IC tag 30 and the pieces of information (Tables 1 to 3 and the formulas (1) and (2)) stored in the nonvolatile memory 21 and causes the display portion 23 to display the exchange timing of the process cartridge 11.

Thus, by using the contact pressure information and the initial film thickness information which are stored in the storing medium mounted to the process cartridge 11, proper exchange timing of the process cartridge can be notified with reliability, and a load on the operator can be alleviated.

Other Embodiments

The present invention was described based on the specific embodiments mentioned above, but is not limited to the above-mentioned embodiments.

In the above-described embodiments, the estimate lifetime (exchange timing of the process cartridge 11) of the photosensitive member was discriminated by the cumulative image forming sheet number, but can be discriminated by any information when the information relates to an amount of use of the photosensitive member. For example, the estimate lifetime of the photosensitive member may also be discriminated on the basis of accumulative charging time (in which the photosensitive member is charged), a cumulative charging distance (traveling distance of the photosensitive member during the charging), a cumulative traveling time of the photosensitive member, or a cumulative traveling distance of the photosensitive member, after the process cartridge is exchanged.

Further, in Embodiments 1 to 3, the contact pressure information and the initial film thickness information was indicated on the seal (i.e., the indicating portion provided on the process cartridge itself) applied onto the process cartridge, but the present invention is not limited thereto. A provider of the process cartridge can present the contact pressure information and the initial film thickness information to the operator through any means for each of individual cleaning members, photosensitive members or process cartridges or for each of production lots. For example, the provider can present the contact pressure information and the initial film thickness information through articles, such as a package and a manual of the process cartridge, circulated together with the process cartridge or through the process cartridge on a network or on a homepage (website) of the provider of the image forming apparatus.

In Embodiments 1 to 3, the operator inputted the contact pressure information and the initial film thickness information, but the information inputted by the operator is not required to be the contact pressure information itself or the initial film thickness information itself. For example, an individual identification number or a lot number of the process cartridge may also be used when the information is capable of identifying the contact pressure information or the initial film thickness information in the process cartridge. For example, there is a case that the controller provided in the apparatus main assembly is connected with the network through a network-connecting portion. In this case, for example, the contact pressure information and the initial film thickness information may also be stored, in a state of being associated with the individual identification number or the lot number, in an external storing portion at a service location of the provider of the process cartridge or the image forming apparatus. This external storing portion and the controller provided in the apparatus main assembly are connected with the network through the network-connecting portion. The operator inputs the individual identification number or the lot number of the process cartridge mounted in the apparatus main assembly into the controller through the operating portion provided on the apparatus main assembly. The individual identification number and the lot number can be presented by the process cartridge itself or the articles, such as the package and the manual of the process cartridge, circulated together with the process cartridge. Then, the controller is capable of acquiring, from the external storing portion, the contact pressure information and the initial film thickness information which correspond to the inputted individual identification number and the inputted lot number.

In Embodiments 1 to 3, not only the exchange timing of the process cartridge was acquired from the contact pressure information or the initial film thickness information inputted by the operator and was displayed, but also the information on the exchange timing was stored in the nonvolatile memory provided in the apparatus main assembly. On the other hand, the contact pressure information and the initial film thickness information inputted by the operator may also be stored in the nonvolatile memory provided in the apparatus main assembly. In this case, for example, depending on a demand such that the operator inputs an instruction through the operating portion, it becomes easy to acquire and notify the exchange timing of the process cartridge at any timing. Also in the case where the contact pressure information and the initial film thickness information are stored in the IC tag as in Embodiment 3, the contact pressure information and the initial film thickness information may also be stored in the nonvolatile memory provided in the apparatus main assembly.

In the above-described embodiments, in the case where the photosensitive member reached the end of the lifetime thereof, that effect was notified to the operator, but approach to the end of the lifetime of the photosensitive member may also be notified earlier and notification may also be made in a plurality of stages such that the approach to the end of the photosensitive member lifetime is notified and then arrival of the end of the photosensitive member lifetime is notified. These notifying methods are not limited to visual methods using characters, symbols and the like, but may also be auditory methods such as voice, alarm (warning sound) and the like.

In the above-described embodiments, in the case where the photosensitive member reached the end of the lifetime thereof, that effect was automatically notified to the operator, but the remaining lifetime of the process cartridge may be notified at any timing depending on, e.g., the demand such that the operator inputs the instruction through the operating portion. In this case, the controller compares the information on the estimate lifetime which was acquired similarly as in the above-described embodiments and which was stored in the nonvolatile memory, with the information on the amount of current use of the photosensitive member, and thus acquires the remaining lifetime of the process cartridge and can display this remaining lifetime.

In the above-described embodiments, the operating portion and the display portion were provided on the apparatus main assembly, but these portions may also be those provided in, for example, a device (such as a personal computer) communicatably connected with the apparatus main assembly.

In the above described embodiments, in the image forming apparatus, the process cartridge integrally including the photosensitive member, the cleaning member and the charging means and detachably mountable to the apparatus main assembly was used, but the present invention is not limited thereto. For example, in addition to the above means, the developing means may also be integrally assembled into the process cartridge. The charging means may also be not integrally assembled into the process cartridge. The cleaning member and the photosensitive member may also be individually exchangeable.

Further, in the above-described embodiments, the case where the contact pressure of the cleaning member to the photosensitive member was different depending on the manufacturing variation was described as an example, but the present invention is not limited thereto. For example, the present invention is applicable even in the case where the setting of the contact pressure is intentionally changed due to an arbitrary reason such as a change in setting due to a difference in type (model) of the image forming apparatus, a change in setting due to a use (operation) environment or use status of the image forming apparatus by the user, or the like. This is also true for the initial film thickness.

Further, the present invention can also be applied to an image forming apparatus including only the single photosensitive member as the image bearing member.

The present invention particularly suitably acts on the case where the cleaning member is the cleaning blade, but the cleaning member is not limited to the blade-shaped cleaning member. For example, in the case where a cleaning member, such as a block-shaped (pad-shaped) cleaning member of which contact pressure to the photosensitive member has the influence on the lifetime of the photosensitive member, an effect similar to the above-described effect can be expected by applying the present invention to the cleaning member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-126038 filed on Jun. 24, 2016, which is hereby incorporated by reference herein in its entirety.

What is claimed is:

1. An image forming apparatus comprising:

a cartridge configured to be detachably mountable to a main assembly of the image forming apparatus, said cartridge including an image bearing member, a cleaning member, and an information holding portion, said image bearing member being configured to bear a toner image, said cleaning member being provided in contact with said image bearing member and being configured to remove toner remaining on a surface of said image bearing member, said information holding portion being configured to hold pressure information regarding contact pressure of said cleaning member against said image bearing member, the contact pressure being measured by using a measuring jig in advance;

a transfer member configured to transfer the toner image from said image bearing member onto a toner image receiving member;

an input portion configured to input the pressure information;

a display portion configured to display lifetime information regarding a lifetime of said cartridge; and a controller configured to carry out a process for displaying the lifetime information on said display portion on the basis of the pressure information.

2. An image forming apparatus according to claim 1, wherein said controller carries out, as the process, a process in which an index value indicating timing when said cartridge reaches an end of a lifetime thereof is acquired on the basis of the pressure information, and a process in which the acquired index value is displayed on said display portion.

3. An image forming apparatus according to claim 2, wherein the pressure information includes the contact pressure divided into a plurality of components of the contact pressure with respect to a longitudinal direction of said cleaning member.

4. An image forming apparatus according to claim 1, wherein said controller carries out, as the process, a process in which an index value indicating timing when said cartridge reaches an end of a lifetime thereof is acquired on the basis of the pressure information, a process in which on the basis of the acquired index value and information regarding an amount of use of said cartridge a remaining lifetime of said cartridge is determined, and a process in which prompting of exchange of said cartridge or the remaining lifetime of said cartridge is displayed on said display portion.

5. An image forming apparatus according to claim 4, wherein the amount of use of said cartridge includes at least one of a cumulative number of images, a cumulative charging time of said image bearing member, a cumulative charging distance of said image bearing member, a cumulative traveling time of said image bearing member, and a cumulative traveling distance of said image bearing member in said cartridge.

6. An image forming apparatus according to claim 1, wherein the lifetime information displayed on said display portion is shorter when the contact pressure is a second contact pressure larger than a first contact pressure as opposed to when the contact pressure is the first contact pressure.

7. An image forming apparatus according to claim 1, wherein said information holding portion comprises an indicating portion on which the pressure information is indicated, and wherein said input portion comprises an operating portion through which the pressure information is inputted by an operator.

8. An image forming apparatus according to claim 7, wherein the indicating portion comprises a seal applied on said cartridge.

9. An image forming apparatus according to claim 1, wherein said information holding portion comprises a storing medium in which the pressure information is stored, and wherein said input portion comprises a reading portion to read the pressure information from the storing medium.

10. An image forming apparatus according to claim 9, wherein the storing medium is an IC tag mounted to said cartridge.

11. An image forming apparatus according to claim 1, wherein said image bearing member is a photosensitive member including a base material and a photosensitive layer provided on the base material, and said information holding portion holds the pressure information and thickness information regarding a thickness of the photosensitive layer measured at an initial stage of use of said cartridge in advance, and wherein said controller carries out the process for displaying the lifetime information on said display portion on the basis of the pressure information and the thickness information.

12. An image forming apparatus according to claim 11, wherein said controller carries out, as the process, a process in which an index value indicating timing when said photosensitive member reaches an end of a lifetime thereof is acquired on the basis of the pressure information and the thickness information, and a process in which the acquired index value is displayed on said display portion.

13. An image forming apparatus according to claim 11, wherein said controller carries out, as the process, a process in which an index value indicating timing when said photosensitive member reaches an end of a lifetime thereof is acquired on the basis of the pressure information and the thickness information, a process in which on the basis of the acquired index value and information regarding an amount of use of said cartridge a remaining lifetime of said cartridge is determined, and a process in which prompting of exchange of said cartridge or the remaining lifetime of said cartridge is displayed on said display portion.

14. An image forming apparatus according to claim 13, wherein the amount of use of said cartridge includes at least one of a cumulative number of images, a cumulative charging time of said image bearing member, a cumulative charging distance of said image bearing member, a cumulative traveling time of said image bearing member, and a cumulative traveling distance of said image bearing member in said cartridge.

15. An image forming apparatus according to claim 11, wherein the lifetime information on said display portion is shorter when the contact pressure is a second contact pressure larger than a first contact pressure as opposed to when the contact pressure is the first contact pressure in a case that the initial film thickness is the same, and the lifetime information on said display portion is shorter when the initial film thickness is a second film thickness thinner than a first film thickness as opposed to when the initial film thickness is the first film thickness in a case that the contact pressure is the same.

16. An image forming apparatus according to claim 11, wherein said information holding portion comprises an indicating portion on which the pressure information and the thickness information are indicated, and wherein said input portion comprises an operating portion through which the pressure information and the thickness information are inputted by an operator.

17. An image forming apparatus according to claim 16, wherein the indicating portion comprises a seal applied on said cartridge.

18. An image forming apparatus according to claim 11, wherein said information holding portion comprises a storing medium in which the pressure information and the thickness information are stored, and wherein said input portion comprises a reading portion to read the pressure information and the thickness information from the storing medium.

19. An image forming apparatus according to claim 1, wherein the pressure information includes the contact pressure divided into a plurality of components of the contact pressure with respect to a longitudinal direction of said cleaning member.

20. An image forming apparatus according to claim 1, wherein said cleaning member is a cleaning blade.

* * * * *